US006895807B2

(12) United States Patent
Han et al.

(10) Patent No.: US 6,895,807 B2
(45) **Date of Patent: *May 24, 2005**

(54) APPARATUS AND METHOD FOR DETERMINING OIL CHANGE BASED UPON OIL VISCOSITY

(75) Inventors: Taeyoung Han, Bloomfield Hills, MI (US); Su-Chee Simon Wang, Troy, MI (US); Mark K Krage, Troy, MI (US); Yingjie Lin, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/948,604

(22) Filed: Sep. 23, 2004

(65) Prior Publication Data

US 2005/0039521 A1 Feb. 24, 2005

Related U.S. Application Data

(63) Continuation of application No. 10/423,308, filed on Apr. 25, 2003.

(51) Int. Cl.[7] ..... G01N 33/26; G01N 11/00

(52) U.S. Cl. ..... 73/53.05; 73/54.01; 73/54.02; 73/117.3

(58) Field of Search ..... 73/54.01, 54.02, 73/53.05, 53.01, 54.42, 61.76, 61.78, 117.3

(56) References Cited

U.S. PATENT DOCUMENTS

| | | | | |
|---|---|---|---|---|
| 4,533,900 | A | 8/1985 | Muhlberter et al. | 340/457.4 |
| 4,677,847 | A | 7/1987 | Sawatari et al. | 73/53.05 |
| 5,646,341 | A | 7/1997 | Schricker et al. | 73/117.3 |
| 5,750,887 | A | 5/1998 | Schricker | 73/117.3 |
| 6,253,601 | B1 | 7/2001 | Wang et al. | 73/117.3 |
| 6,508,100 | B2 | 1/2003 | Berndorfer | |
| 6,513,368 | B2 | 2/2003 | Bondarowicz et al. | 73/53.05 |
| 6,575,018 | B2 | 6/2003 | Berndorfer et al. | 73/54.01 |
| 2003/0005751 | A1 | 1/2003 | Berndorfer et al. | 73/54.01 |

OTHER PUBLICATIONS

S. Manco, Nervegna, M. Rundo, G. Armenio, D. Pachetti and R. Trichilo, Gerotor Lubricating Oil Pump fir IC Engines, 1998 Society of Automotive Engineers, Inc., pp. 1–17.

*Primary Examiner*—Daniel S. Larkin
(74) *Attorney, Agent, or Firm*—Jimmy L. Funke

(57) ABSTRACT

An oil change sensing system for an internal combustion engine, having an oil pressure sensor adapted to provide an oil pressure signal to an engine control module; an oil temperature sensor adapted to provide an oil temperature signal to the engine control module; wherein the engine control module comprises an algorithm which determines the oil's viscosity by using the measured oil temperature and oil pressure and the determined oil viscosity and a fresh oil viscosity are used to determine whether the oil is in a preferred operating range.

10 Claims, 6 Drawing Sheets

APPARATUS AND METHOD FOR DETERMINING OIL CHANGE BASED UPON OIL VISCOSITY

CROSS REFERENCE TO RELATED APPLICATION

The present application is a continuation application of U.S. application Ser. No. 10/423,308 filed on Apr. 25, 2003.

TECHNICAL FIELD

The present disclosure generally relates to oil lubricating systems of internal combustion engines and more particularly to a method and apparatus for determining whether the oil of the engine requires changing.

BACKGROUND

The present disclosure relates to an apparatus and method for automatically indicating when-to change the engine lubricating oil by measuring the oil's viscosity. Traditionally, engine oil is changed whenever the vehicle reaches a predetermined mileage, or a specified time interval, which ever comes first. Under severe operating conditions, however, the vehicle manufacturers may suggest that the engine oil be changed more frequently.

These situations require the operator of the vehicle to make a judgment as to when to change the engine oil. This judgment is typically a guess, since the operator has no physical data on which to base the judgment. Typically, degradation of the engine oil occurs most rapidly at high and low temperature extremes. At high oil temperatures, antioxidants in the oil tend to become depleted, and the oil becomes more viscous and acidic due to oxidation. In addition, insoluble particles are deposited on the engine surfaces. At low oil temperatures, fuel, water and soot tend to accumulate in the oil, reducing its viscosity and increasing wear.

Uncertainty of when to change the engine oil may result in changing the engine oil more frequently than is necessary, which is a waste of money, or not changing the oil frequently enough, resulting in shortened engine life. "Good" oil has viscosity characteristics sufficient to give good hydrodynamic lubrication of the loaded surfaces, yet flows around the engine well enough to provide a continuous supply of fresh lubricant. Therefore, oil viscosity is a useful parameter for determining when the oil needs to be changed.

SUMMARY

It is therefore a general object of the present disclosure to provide a reliable and practicable system and method for calculating and indicating when the oil of an engine needs to be changed.

An oil change sensing system for an internal combustion engine, comprising: an oil pressure sensor adapted to provide an oil pressure signal to an engine control module; an oil temperature sensor adapted to provide an oil temperature signal to the engine control module; a sensor for providing a signal to the engine control module, the signal being indicative of the rpm of the engine; wherein the engine control module comprises an algorithm which determines the oil viscosity of new or fresh oil by measuring two oil pressures at two different operating conditions and determines the oil viscosity of old or used oil by measuring two oil pressures at two different operating conditions and determines whether the oil is in a preferred range by comparing the determined used or old oil viscosity with the determined new or fresh oil viscosity.

A method for indicating whether the oil of an engine should be changed, comprising: determining if the oil in the engine has been changed and determining the new oil viscosity by: determining if the flow of the oil is unregulated, by measuring the oil pressure and the oil temperature; measuring the oil pressure at two different operating conditions (x) and (y) if the flow of the oil is unregulated; determining a new oil viscosity; registering the new oil viscosity; and determining if the oil viscosity is in a preferred range by: determining if the flow of the oil is unregulated, by measuring the oil pressure and the oil temperature; measuring the oil pressure at two different operating conditions (x) and (y) if the flow of the oil is unregulated; determining a used oil viscosity; using the used oil viscosity and the new oil viscosity to determine whether the oil's viscosity is in a preferred range.

An oil change sensing system for an internal combustion engine, having an oil pressure sensor adapted to provide an oil pressure signal to an engine control module; an oil temperature sensor adapted to provide an oil temperature signal to the engine control module; wherein the engine control module comprises an algorithm which determines the oil's viscosity by using the measured oil temperature and oil pressure and the determined oil viscosity and a fresh oil viscosity are used to determine whether the oil is in a preferred operating range.

A method for indicating whether the oil of an engine should be changed by determining if the flow of the oil is unregulated, by measuring the oil pressure and the oil temperature and measuring the oil pressure and retrieving a used oil viscosity from a look up table; and using the used oil viscosity and a fresh oil viscosity to determine whether the oil's viscosity is in a preferred range.

An apparatus for determining whether the oil of an engine requires changing, comprising: an engine control module having a microprocessor; an oil temperature sensor adapted to provide an oil temperature signal to an algorithm of the microprocessor; an oil pressure sensor adapted to provide an oil pressure signal to the algorithm; a look up table comprising data corresponding to used or fresh oil viscosities as a function of at least one of the following parameters oil pressure, oil temperature and engine rpm; and a means for indicating whether the oil viscosity is outside a preferred range.

DETAILED DESCRIPTION

Oil pressure is a measure of the oil's resistance to flow. In an engine, oil pressure is a function of two factors: oil viscosity and oil flow rate. Oil flow rate is a function of engine rpm and oil flow regulation. Thus, for a constant engine rpm and without oil flow regulation oil pressure is a function of oil viscosity. Most new engines today use Gerotor pumps, which are a positive displacement type of pump. For a given flow rate, the pressure generated by the pump increases with oil viscosity. Flow rates of the positive displacement type pumps are proportional to the speed (rpm) of the oil pump. Since, the Gerotor pump speed is directly proportional to engine speed, the flow rate is also proportional to engine speed. For a given engine speed (rpm) such as idle, the oil flow rate is nearly constant and the oil pressure is mainly a function of oil viscosity. However, oil viscosity is very sensitive to the temperature of the oil and decreases as the temperature of the oil increases. Thus, the oil pressure at the pump tends to decrease as the oil temperature increases. Conversely, as the oil temperature decreases, oil pressure at the pump increases. Therefore, by measuring the oil pressure and the oil temperature, we can build the relationship between the oil viscosity and the oil pressure.

Figure 1:
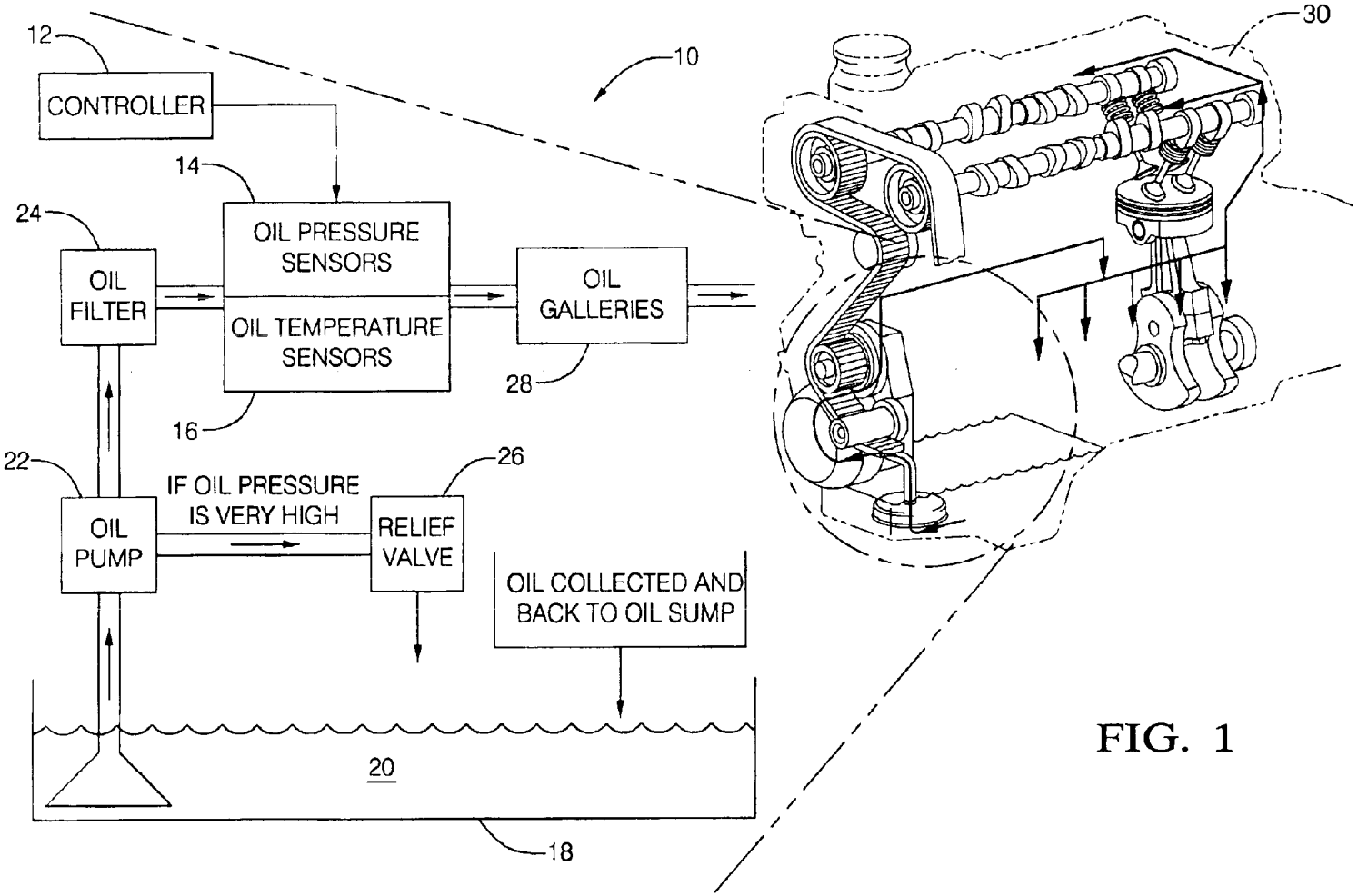
FIG. 1 is a schematic illustration of an oil lubrication system.

An engine oil lubrication system is shown schematically in FIG. 1. The system shown in FIG. 1 is for explanation purposes and is not intended to limit the scope of the present disclosure.

Figure 2:
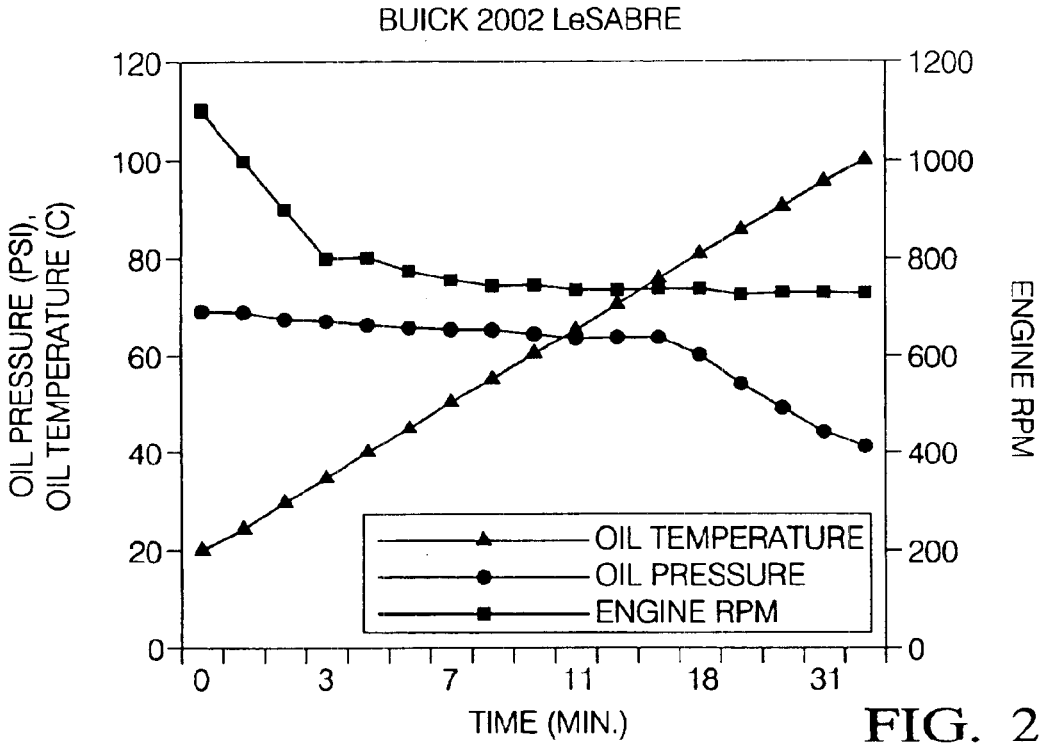
FIG. 2 is a chart illustrating test results of oil temperature, oil pressure and engine rpms measured with respect to time for a particular vehicle and engine.

Referring to FIG. 2 and in order to demonstrate and prove the concept of the present disclosure, the oil temperature of a vehicle engine was measured during warm-up (e.g., transitioning from a cold start to normal operating temperatures and RPMs) using a thermocouple inserted into the engine of a Buick Lesabre (2002 model year) with a 3800 V6 engine. This vehicle is equipped with a dash display that shows oil pressure. The oil in the engine was 5W30, about one month old, and experienced about 1500 miles driving. During 35 minutes of idling, the oil temperature increased from 20° Celsius to 100° Celsius at an ambient air temperature of 18° Celsius. As shown in FIG. 2, the engine rpm decreased from 1100 rpm to 730 rpm roughly after 7 minutes. During this period the oil temperature increased almost linearly with time. Also, the initial oil pressure was 69 psi, which decreased slowly during the first 18-minutes and then decreased rather rapidly.

Figure 3:
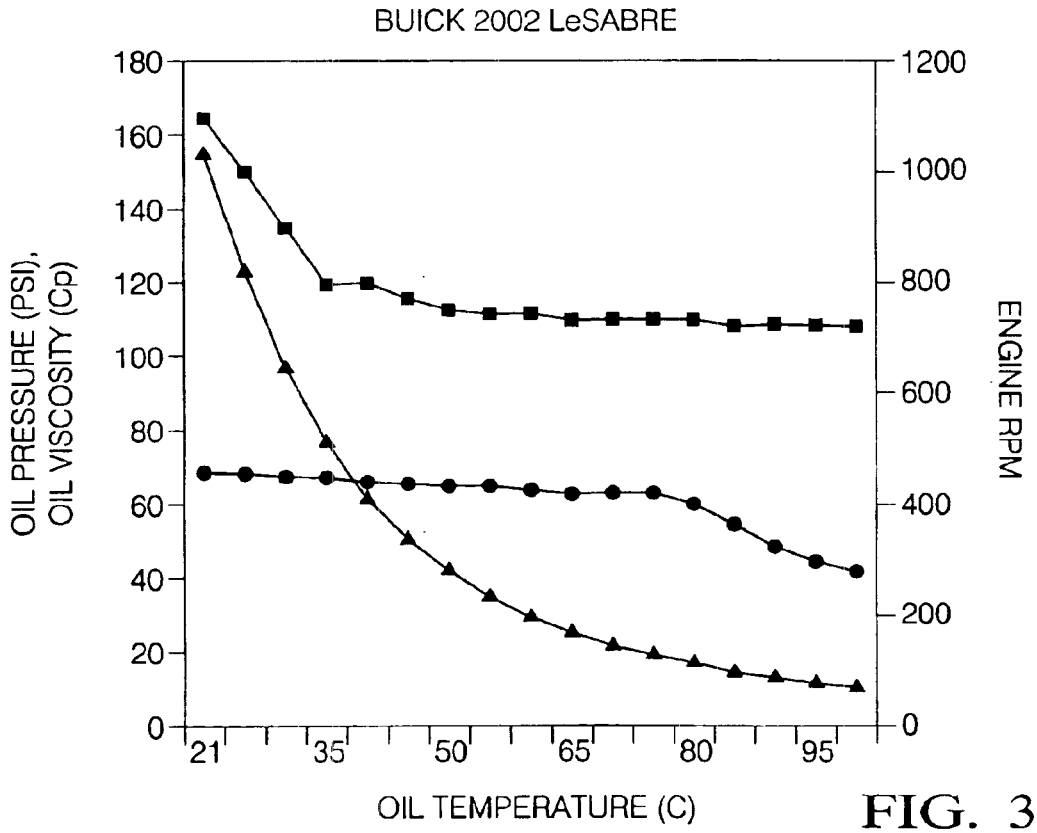
FIG. 3 is a chart illustrating test results of oil pressure, oil viscosity and engine rpms measured with respect to oil temperature for a particular vehicle and engine.

The same test data are plotted as a function of oil temperature in FIG. 3. As shown in FIG. 3, the oil pressure does not vary significantly with changes in oil viscosity when the oil temperature is less than 80° Celsius. This is mainly because the oil flow is regulated to prevent excessive pressure build up at the oil filter assembly when the oil viscosity is high. The regulation of the oil flow is provided by a relief valve, which is opened to prevent excessive build-up in the system, for example in the oil filter. When the oil temperature exceeded 80° Celsius at an idle speed, the oil flow rate became unregulated wherein the relief valve was closed, and accordingly the oil pressure was directly related to the oil viscosity. It is at this point where the system and method of the present disclosure will determine whether the oil of an engine requires changing by measuring the viscosity.

Figure 4:
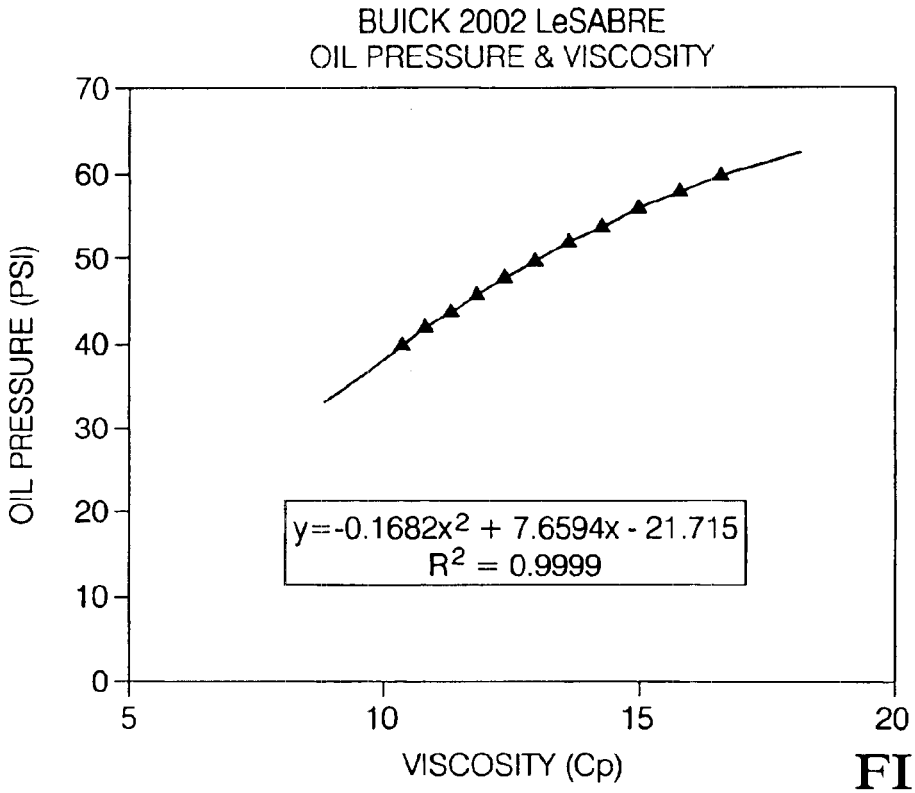
FIG. 4 is a chart illustrating the relationship between oil pressure and oil viscosity for a particular engine, vehicle and oil.
Figure 5:
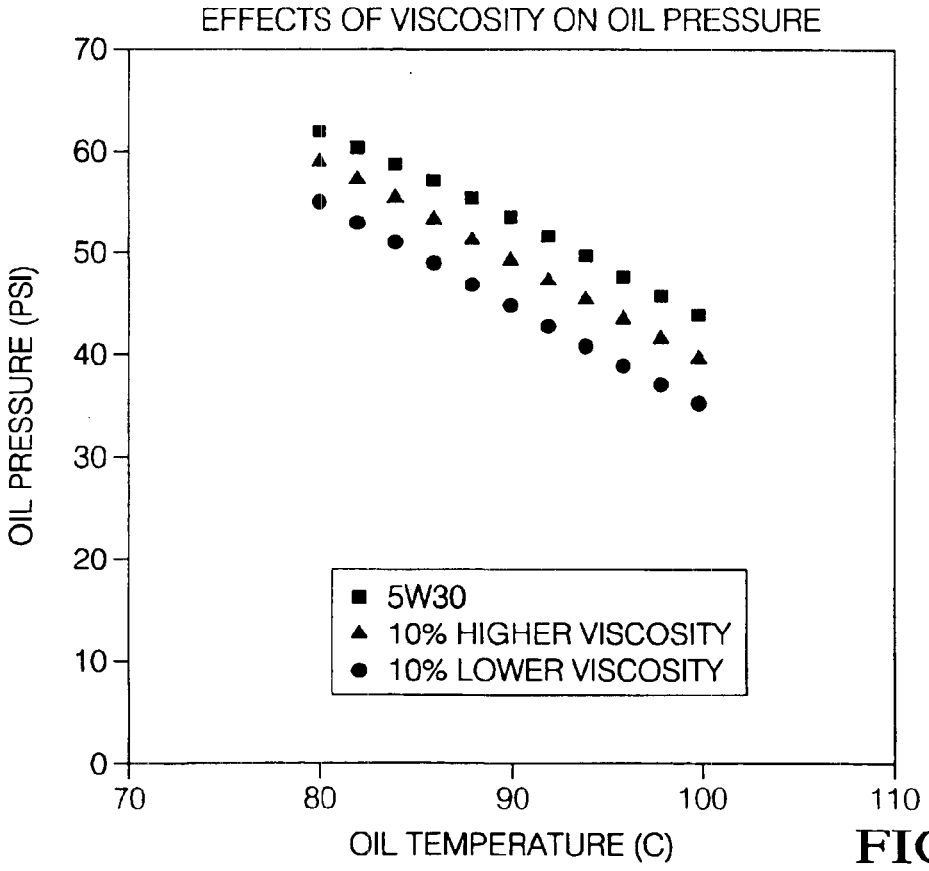
FIG. 5 is a chart illustrating the effect of viscosity on oil pressure for a particular engine, vehicle and oil.

The relationship between the engine oil pressure and the oil viscosity (5W30, one month old and experienced about 1500 miles driving) for oil at temperatures between 80° Celsius and 100° Celsius is shown in FIG. 4. A simple quadratic function is sufficient to fit this data very accurately. From this relationship, the effect of the oil viscosity on oil pressure can be derived. As shown in FIG. 5, a −10% or +10% change of oil viscosity is roughly equivalent to an oil pressure change of about 5 psi, or in other words, a 20% increase in the oil viscosity results in roughly 10 psi increase of the oil pressure. As mentioned above, the engine oil pressure is caused by the resistance to the oil flow under pumping action. Besides viscosity, any changes in the oil delivery system, such as pump efficiency, oil galleries, and filtering performance, could also affect this resistance and thus the measured oil pressure.

In order to avoid these effects of potential system changes on the oil pressure measurements, we can also incorporate the measured pressure difference at two different oil temperatures. Typically, degraded old oil viscosity decreases faster with oil temperature increase than the case for the fresh oil. This can be accomplished by conducting the oil pressure measurement at two different temperatures. Of course, oil pressure measurements can be made at more than just two different oil temperatures.

Figure 6:
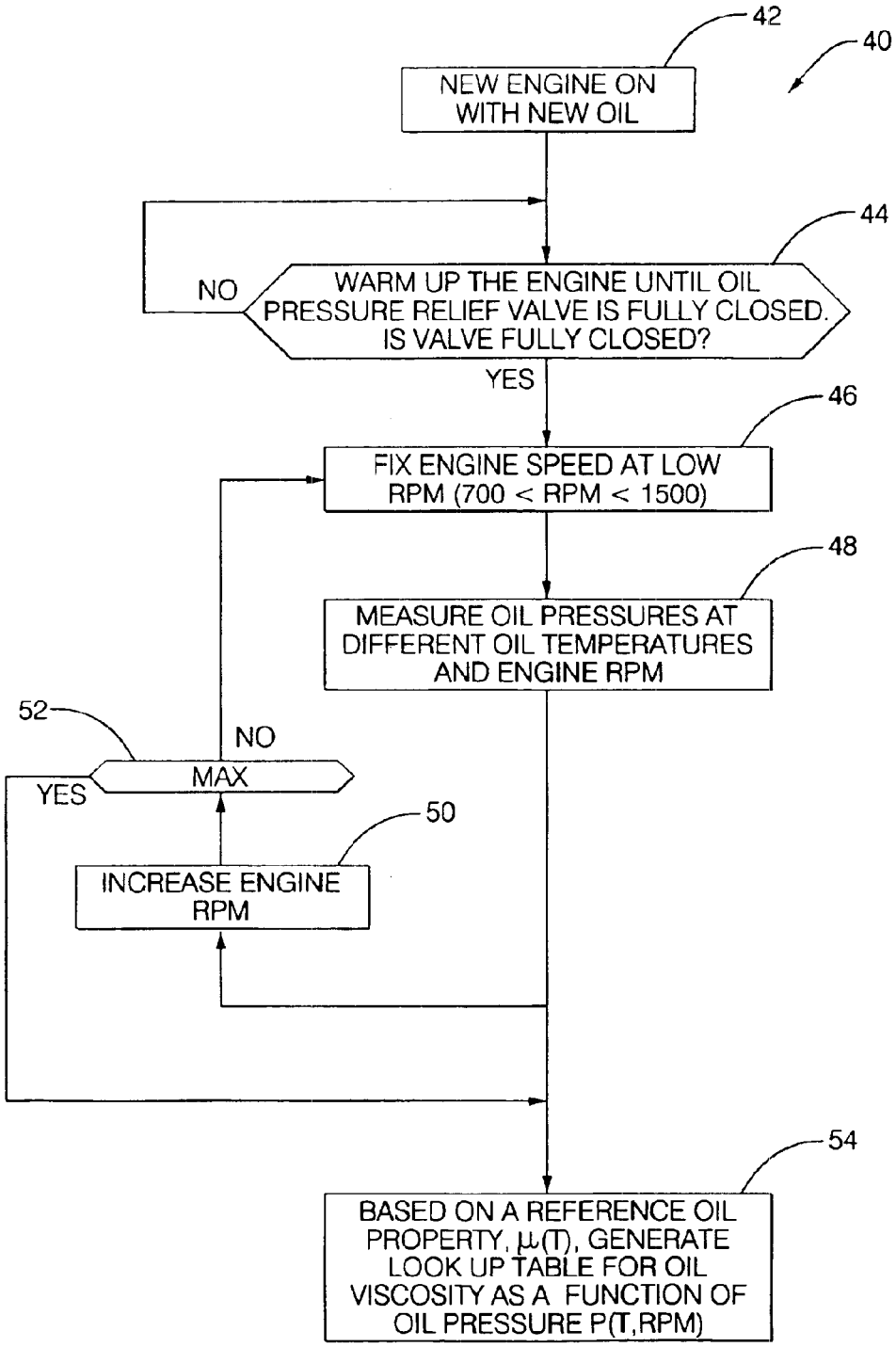
FIG. 6 is a flow chart illustrating a control algorithm for developing a look up table during an initial oil viscosity calibration stage for use in the method and apparatus of the present disclosure.
Figure 7:
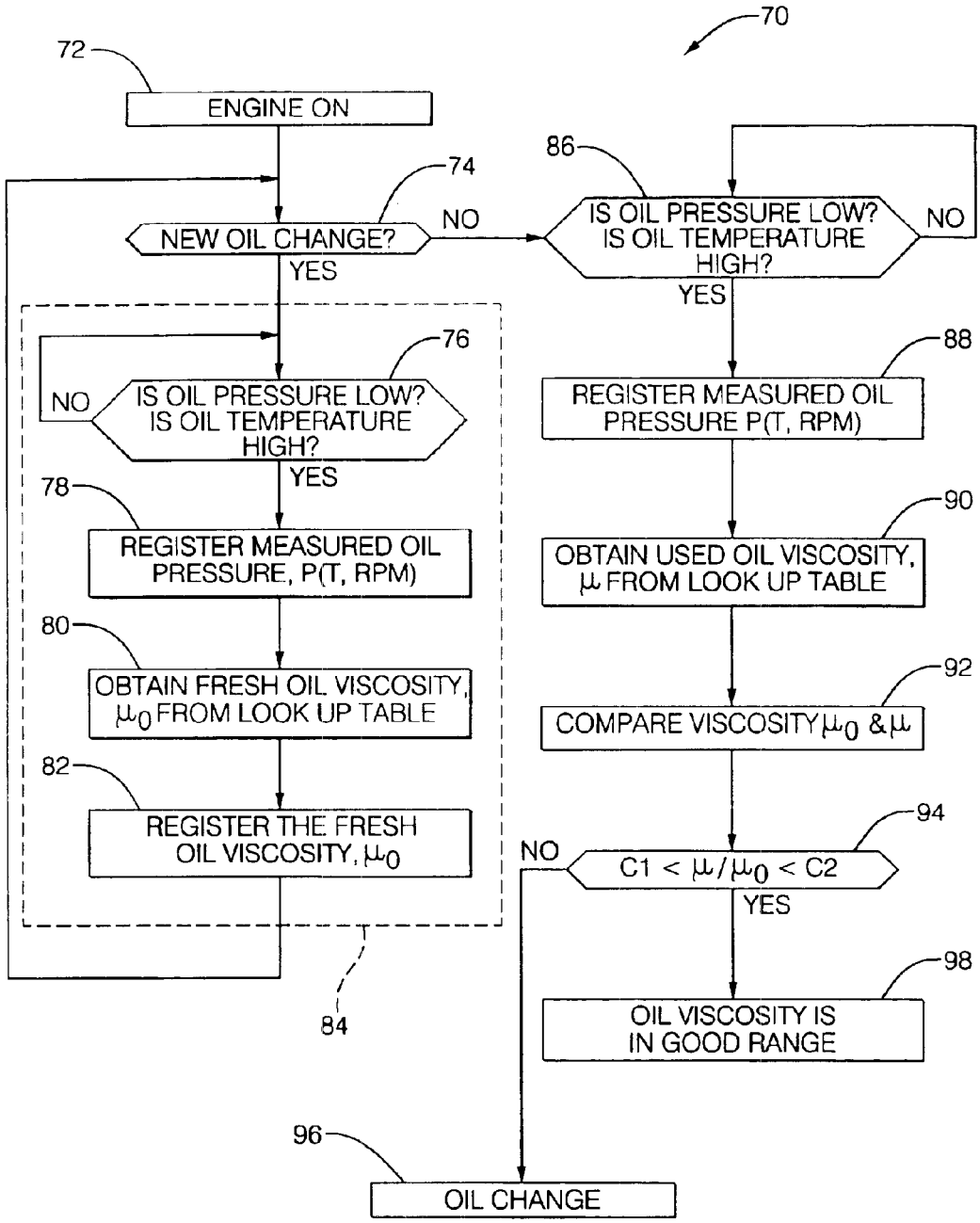
FIG. 7 is a flow chart illustrating a control algorithm for determining the oil's viscosity by taking oil pressure measurements and using the look up table generated by the algorithm of FIG. 6.

In real vehicle applications, the oil pressure information is utilized to estimate the viscosity of the engine oil when the oil temperature is high enough (e.g., greater than (>) 80° Celsius as illustrated in the example of FIGS. 2–5) and at low engine speed, such as idle. An algorithm for determining oil pressure calibration with oil viscosity is shown in FIG. 6. The actual viscosity measurement procedure used in vehicular or other dynamic applications is shown in FIG. 7.

Referring back to FIG. 1, an oil indicator system 10 for a diesel, gas, or other equivalent internal combustion engine is schematically illustrated. The system includes a microprocessor or electronic controller 12 for processing sensor input data and generating an output. The electronic controller of the oil indicator system may be integrally combined or closely associated with the Electronic Control Module (ECM) that is conventionally provided on most modern diesel or gasoline engines, or may alternatively be a separate component from the ECM.

The electronic controller includes an input in electrical communication with a plurality of sensors for sensing or determining a plurality of oil operating parameters. As an alternative, the sensors may be in wireless (RF) communication with the controller. Of course, other equivalent means of communication are considered to be within the scope of the present disclosure. Such parameters may include oil pressure and oil temperature that are generated in the oil circulation system and are used to provide the required information. For example, an oil pressure sensor 14 and an oil temperature sensor 16 are disposed to provide readings of the oil as it circulates through the system. It will be appreciated to those skilled in the art that these oil sensors may be preexisting or already provided on conventional newly built engines wherein the sensors are in communication with the ECM and, in order to implement the method of the present disclosure, additional software is only added to the microcontroller. Of course, and in other applications the required sensors are positioned within the oil circulation system.

The oil circulation system schematically illustrated in FIG. 1 also includes an oil sump 18 wherein oil 20 circulated or pumped through the system via an oil pump 22 fluidly connected with the sump and an oil filter 24. As discussed above the oil circulation system includes a pressure relief valve 26 that is in fluid communication with the oil pump and the oil sump wherein the relief valve is calibrated to prevent excessive oil pressure build up within the oil circulation system. In order to prevent excessive build up of oil pressure the relief valve opens and the oil flow is regulated. The oil as indicated by the arrows in FIG. 1 is pumped to the oil galleries 28 of an internal combustion engine 30 thereby lubricating the moving part of the engine. Accordingly, the oil is circulated through the engine in accordance with known technologies.

Referring now to FIGS. 2–6, the creation of a look-up table for use in an algorithm and system (FIG. 7) resident upon a microprocessor of a vehicle is illustrated. Again, and as discussed above, the quadratic formula of FIG. 4 is determined when the flow and pressure of the oil is unregulated (oil pressure relief valve closed) see also FIGS. 2, 3 and 5. FIG. 6 illustrates an algorithm 40 for a procedure to develop a look up table during the initial viscosity calibration stage. It is noted that this procedure can be performed for numerous engine types (e.g., 4, 6, 8 and 12 cylinder engines) of varying sizes, each having varying performance standards as well as oils of different weight and type (synthetic, non-synthetic or mixes, blends etc.). Accordingly, individual look up tables can be generated for engine types as well as oil types. Thus, the look up table will have a sufficient amount of data to provide a means for determining whether the oil requires changing when it is measured by a system in accordance with the present disclosure. The look up table is generated in a laboratory environment wherein it can be tested and ultimately validated for use in a system of a vehicle or other item having an internal combustion engine and an engine control module or equivalent thereof.

As an alternative to the look up table generation in a laboratory environment and in an alternative embodiment (FIG. 8), a similar relationship is created between the fresh oil viscosity and the oil temperature. In this embodiment, the entire process takes place in the vehicle being driven right after an oil change and every day thereafter. This procedure can be performed either in a laboratory environment or during actual vehicle driving conditions. The detailed procedure is described in FIG. 8.

Referring back now to FIG. 6, algorithm 40 is initialized at block 42 when a new engine is started with new oil. At block 44 the algorithm will determine when the engine is warmed up to the point that the oil pressure is in an unregulated state (e.g., corresponding to the relief valve of the oil pump being closed) thus, the oil pressure measurements are directly related to the oil viscosity. Step or block 44 determines that the oil pressure relief valve is fully closed by measuring the oil temperature or other parameter, which will indicate whether the engine is in a state where the pressure relief valve will be closed. This can also be determined by knowing the operational parameters of the oil pump and valve (provided by the manufacturer) or by directly measuring the position of the pressure relief valve though the use of a sensor appropriately positioned to determine the position of the valve (e.g., open or closed) and provide the sensed information back to the microcontroller. Once this is determined by block 44, the engine speed is fixed at low rpm (revolutions per minute) by block or step 46 of the algorithm. If not, algorithm 40 remains at step 44 until the pressure relief valve is fully closed.

Once step or block 44 determines that valve is fully closed (oil pressure being unregulated), step or block 46 will fix the engine speed at a predetermined point and the algorithm will advance to step or block 48 wherein the oil pressure is measured and the corresponding oil temperature and engine speed is also recorded. Once this data is recorded the algorithm at step or block 50 increases the engine rpm incrementally. For example, step 50 could use the following formula (x(rpm)=x(rpm)+y(increment)) wherein x(rpm) is the engine speed and y(increment) is the incremental increase.

Next, a decision node 52 determines whether the upper range of the fixed engine speed has been determined. Accordingly, the loop of steps 46, 48, 50 and 52 is repeated until all of the desired data points are recorded. For example, in the example illustrated in FIG. 6, the fixed engine speed is defined by the range between 700 and 1500 rpm. Of course, it is contemplated that the range may include values greater or less than the aforementioned values. Accordingly, and in the example provided once the engine rpm has been increased to a value greater than 1,500 rpm algorithm 40 advances on to step 54. At step 54 data for a look up table for the engine oil is generated based upon a reference oil property $\mu(T)$ (viscosity as a function of temperature, which is provided by the oil manufacturer or alternatively a relative oil property $\mu_{old}(T)/\mu_{new}(T)$ for the fresh oil and the used oil can be evaluated from oil pressure measurements during various vehicle driving conditions when the oil pressure relief valve is closed. The detailed procedures of this embodiment are described and illustrated in FIG. 8) and the measured oil pressures as a function of temperature and engine rpm thus, pressure (P) is a function of oil temperature (T) and engine rpm (rpm). Accordingly, P(T, rpm).

In accordance with the example provided in FIGS. 2–6 the following quadratic equation was developed:

$$y=-0.1682x^2+7.6594x-21.715$$

wherein y=oil pressure and x=oil viscosity and $R^2=0.9999$ wherein $R^2$ represents the coefficient of determination which is the strength of association or degree of closeness of the relationship between two variables measured by a relative value. Thus, the value of $R^2=0.9999$ indicates that the quadratic formula is very accurate or the standard of error is very small.

Once the algorithm of FIG. 6 determines the required data for a look-up table for a given engine and oil, the data is available in a transferable format which can be stored in the non-volatile or read only memory of a programmable microprocessor, which is then used in accordance with the present disclosure to determine whether the oil of an engine needs to be changed.

Referring now to FIG. 7, a flow chart 70 of an algorithm for use in a microcontroller of a vehicle (e.g., engine control module ECM) is illustrated. The algorithm in accordance with the present disclosure will determine whether the oil of the vehicle's engine requires changing. The algorithm is provided with a look up table which comprises the data obtained by the algorithm and procedure shown in FIG. 6. Of course, the look up table will include data which is specific to the type of engine and oils contemplated for use with the engine and/or vehicle type.

A first step represented by block 72 determines whether the vehicle's engine is on. This can be determined by any means known to one skilled in the art wherein a signal indicative of a running engine is provided to the engine control module. Once the algorithm determines whether the engine is running, a step represented by block 74 determines whether the engine has recently had an oil change and if this is the first time the engine has been started since the oil change. Block 74 determines whether there has been an oil change through the receipt of a signal from a reset button (not shown) which is manipulated after the oil change. The reset button is currently a standard feature on some of today's production vehicles. Other methods and means for determining and providing a signal indicative of a new oil change may comprise and are not limited to the following: a smart sensor disposed within the oil sump which will determine whether the oil level has dropped dramatically (e.g., consistent with an oil change) or alternatively, a sensor that measures viscosity and provides a signal of a large oil viscosity change. Of course, other sensors and methods, known to individuals skilled in the art for providing a signal indicative of an oil change are contemplated to be within the scope of the present disclosure.

If block 74 determines that there has been an oil change in the engine, a step or block 76 determines whether the engine oil pressure is unregulated (e.g., relief valve of oil pump closed). This is determined at block 76 by measuring the oil pressure and oil temperature of the oil by oil temperature and pressure sensors appropriately positioned to provide such readings to the algorithm of the present disclosure. Alternatively, other means for determining whether the relief valve is closed may be used in accordance with the algorithm of FIG. 7. Once step 76 determines that the oil flow is unregulated, the oil pressure is measured and registered into the look up table of the control algorithm by a step represented by block 78. As mentioned above, the measured oil pressure has a direct correlation with respect to the temperature of the oil and the rpm of the engine into which the oil is located. If on the other hand block 76 determines that the relief valve of the oil pump is still open (regulated flow), block 76 continues to measure the oil pressure and the oil temperature until an unregulated flow (relief valve closed) is detected.

Once block 78 registers the measured oil pressure, step or block 80 obtains the corresponding fresh oil viscosity $\mu_o$ from the look up table. As previously noted, this information is stored in the look up table through the analysis and methods illustrated in FIGS. 2–6 and the readily available data sheets provided by the manufactures of specific oil types, which is all stored in the look up table of algorithm 70.

Once the fresh oil viscosity $\mu_o$ of the new oil is obtained, it is stored in the look up table at step or block 82. The fresh oil viscosity is now stored in the algorithm as a constant for use in the system. It is also noted that the steps or loop outlined by block 84 (dashed lines) are only performed once and only after block 74 determines whether a new oil change has taken place.

In the event that block 74 determines that a new oil change has not taken place, step or block 86 determines whether the engine oil pressure is unregulated (e.g., relief valve of oil pump closed). This is determined at block 86 by measuring the oil pressure and oil temperature of the oil by temperature and pressure sensors appropriately positioned to provide such readings to the algorithm of the present disclosure. Once step 86 determines that the oil flow is unregulated the oil pressure is measured and registered at step or block 88. As mentioned previously during unregulated oil flow, the measured oil pressure has a direct correlation with respect to the temperature of the oil and the rpm of the engine into which the oil is located.

If on the other hand block 86 determines that the relief valve of the oil pump is still open (regulated flow) block 86 continues to measure the oil pressure and the oil temperature until an unregulated flow is detected.

Turning back now to block 88, once the oil pressure is measured, the used oil viscosity $\mu$ is obtained at step or block 90 from the look up table generated by the algorithm of FIG. 6, or alternatively, the aforementioned quadratic formula is used to determine the used oil viscosity. Once the calculations or comparison of block 90 is complete, step or block 92 compares the used oil viscosity $\mu$ with the fresh oil viscosity $\mu_o$ by for example, dividing $\mu$ by $\mu_o$. At this point, the algorithm advances to step or block 94 wherein it is determined whether the compared viscosities are within a predetermined ranged defined by a lower constant C1 and an upper constant C2. If the compared values are outside the range defined by C1 and C2, an oil change signal 96 is generated; otherwise, a non-oil change signal 98 is generated.

Upon receipt of an oil change signal the electronic controller provides an output connected to a display (not shown), which may be an LED signal device or other appropriate display means that is preferably in view of the engine operator, such as in the cab of a vehicle.

The electronic controller utilizes the algorithm which collects data from the sensors and the look up table to periodically determine if the oil needs changing.

A "change oil" warning signal can thus be sent to the vehicle operator when the viscosity estimated at a given oil temperature and engine speed exceeds a predetermined "threshold". It is noted that in accordance with the present disclosure the oil pressure read out is an existing feature readily available on some current production vehicles. Thus, there is no need to add an oil pressure sensor to implement the system of the present disclosure.

A similar concept can be applied to lower end vehicles equipped with an oil pressure switch in place of an oil pressure readout. By calibrating the oil pressure level switch point, monitoring engine speed through one of various means, and measuring the oil temperature at the oil pressure switching point, the corresponding oil viscosity can be estimated. The basic concept of utilizing the oil pressure readout or the oil pressure switch to estimate the oil viscosity and the need to change oil is not limited to automotive applications. It can be applicable to all power generating equipment that utilize a fluid, such as oil, as a lubricating method.

Figure 8:
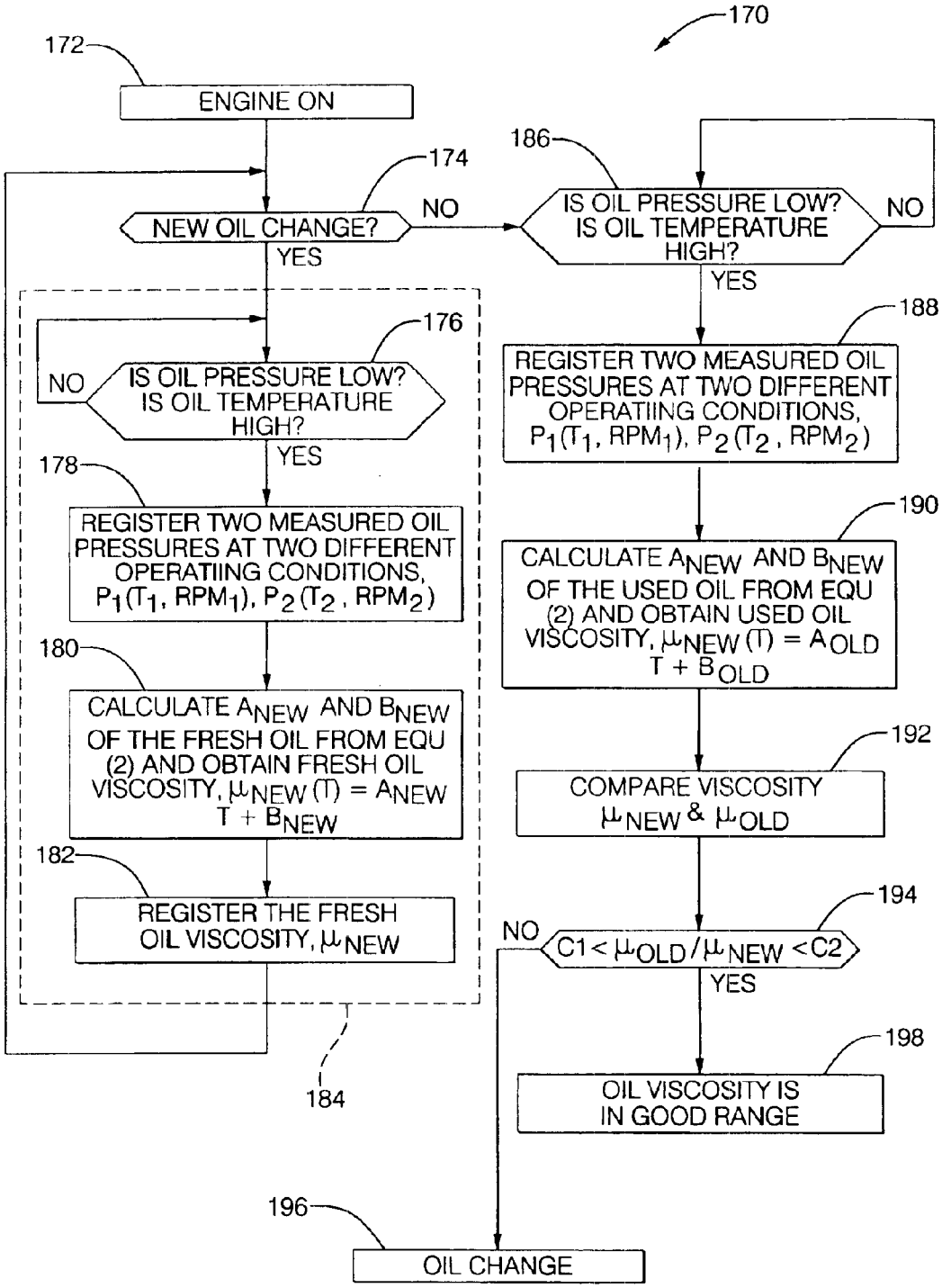
FIG. 8 is a flow chart of an alternative algorithm to obtain oil viscosity directly from two oil pressure measurements in real vehicle operations.

Referring now to FIG. 8, an alternative embodiment of the present disclosure is illustrated. Here components performing similar or analogous functions are numbered in multiples of 100. However, at the outset it is particularly noted that steps 178, 180, 188 and 190 are significantly different from steps 78, 80, 88 and 90 of the FIG. 7 embodiment as will become readily apparent in view of the discussion of FIG. 8 below, as well as FIG. 8 itself.

The detailed procedure to generate a look up table for oil property, $\mu$(T), was described previously. In this embodiment, the approach is to measure directly the oil viscosity, $\mu$(T), during various vehicle operating conditions. As described above, the oil pressure relief valve is closed during low engine rpm and also when the oil temperatures are relatively high, for example, above 80° C. (a Buick Lesabre). The engine operating conditions that we are interested in in the present application occur when the oil temperature is in the range between 80° C. and 120° C. In this range, the oil viscosity decreases almost linearly with oil temperatures and we can approximate the oil viscosity, $\mu$(T), as:

$$\mu(T)=A'\cdot T+B' \quad (1)$$

The constants A' and B' vary as the oil degrades during vehicle operations.

The oil flow conditions in oil galleries are typically laminar flows and oil density is nearly constant for the oil temperature range between 80° C. and 120° C. that we are interested in. For a laminar flow in a channel flow, the total pressure drop is linearly proportional to the product of the oil flow rate and the oil viscosity. Thus, the oil flow rate of the positive displacement type pumps is proportional to the speed (rpm) of oil pump. Since, the oil pump speed is directly proportional to engine speed, the oil flow rate is also proportional to engine speed. Therefore, the oil pressure, P, can be described as:

$$P(\text{rpm},T)=K\cdot\text{rpm}\cdot\mu=\text{rpm}\cdot(A\cdot T+B) \quad (2)$$

where K is a constant for a given engine, which depends, only on the geometry of oil galleries and A and B are oil property constants defined as $$A=A'/K$$

$$B=B'/K$$

The oil property constants (A and B) can be determined from two measured data points during vehicle operations when the oil relief valve is closed. The measured data includes the engine speed (rpm), the oil temperature (T), and the corresponding oil pressure (P). From Equation (2), we can determine A and B for fresh oil and used oil if we monitor oil pressures at two different operating conditions each for the fresh oil and the used oil. The algorithm for this procedure is described in FIG. 8. In order to determine the constant A and B, we need only two data points. However, in order to generate more reliable constants A and B for the oil viscosity model (Equation (1)), we can monitor the oil pressures at more than two operating conditions and we can evaluate or optimize the constants A and B by least square fit of the multiple data points during vehicle operations when the oil relief valve is closed. This procedure described herein, does not require any special corrections or modifications due to oil type or engine type. The algorithm (as shown in FIG. 8) is universal to any oil type and engine type and does not need any additional steps to generate a look up table, which was described in FIG. 6. This algorithm eliminates the step for a look up table generation in a laboratory environment for each engine family.

Referring now to FIG. 8, a flow chart 170 of an algorithm for use in a microcontroller of a vehicle (e.g., engine control module ECM) is illustrated. The algorithm in accordance with the present disclosure will determine whether the oil of the vehicle's engine requires changing.

A first step represented by block 172 determines whether the vehicle's engine is on. This can be determined by any means known to one skilled in the art wherein a signal indicative of a running engine is provided to the engine control module. Once the algorithm determines whether the engine is running, a step represented by block 174 determines whether the engine has recently had an oil change and if this is the first time the engine has been started since the oil change. Block 174 determines whether there has been an oil change through the receipt of a signal from a reset button (not shown) which is manipulated after the oil change. The reset button is currently a standard feature on some of today's production vehicles. Other methods and means for determining and providing a signal indicative of a new oil change may comprise and are not limited to the following: a smart sensor disposed within the oil sump which will determine whether the oil level has dropped dramatically (e.g., consistent with an oil change) or alternatively, a sensor that measures viscosity and provides a signal of a large oil viscosity change. Of course, other sensors and methods, known to individuals skilled in the art for providing a signal indicative of an oil change are contemplated to be within the scope of the present disclosure.

If block 174 determines that there has been an oil change in the engine, a step or block 176 determines whether the engine oil pressure is unregulated (e.g., relief valve of oil pump closed). This is determined at block 176 by measuring the oil pressure and oil temperature of the oil by oil temperature and pressure sensors appropriately positioned to provide such readings to the algorithm of the present disclosure. Alternatively, other means for determining whether the relief valve is closed may be used in accordance with the algorithm of FIG. 8. Once step 176 determines that the oil flow is unregulated, the oil pressure is measured and registered at two different operating conditions, as mentioned above with regard to equations 1 and 2, by a step represented by block 178. As mentioned above, step 178 is significantly different than the algorithm of FIG. 7.

If on the other hand block 176 determines that the relief valve of the oil pump is still open (regulated flow), block 176 continues to measure the oil pressure and the oil temperature until an unregulated flow (relief valve closed) is detected.

Once block 178 registers the two measured oil pressures at two different operating conditions, step or block 180 calculates the constants $A_{new}$ and $B_{new}$ of the fresh oil (e.g., oil change has just occurred) using equation 2 above. Once this has occurred, block 180 obtains the fresh oil viscosity using equation 1 above and the new constants $A_{new}$ and $B_{new}$ of the fresh oil. Thus, step 180 is able to determine the fresh oil viscosity without need for generating a look up as described with regard to FIG. 6. Accordingly, steps 178 and 180 use equations 1 and 2 to ultimately determine the fresh oil viscosity.

Once the fresh oil viscosity $\mu_{new}$ of the new oil is obtained, it is stored or registered at step or block 182. The fresh oil viscosity is now stored in the algorithm as a constant for use in the system. It is also noted that the steps or loop outlined by block 184 (dashed lines) are only performed once and only after block 174 determines whether a new oil change has taken place.

In the event that block 174 determines that a new oil change has not taken place, step or block 186 determines whether the engine oil pressure is unregulated (e.g., relief valve of oil pump closed). This is determined at block 186 by measuring the oil pressure and oil temperature of the oil by temperature and pressure sensors appropriately positioned to provide such readings to the algorithm of the present disclosure. Once step 186 determines that the oil flow is unregulated, the oil pressure is measured and registered at two different operating conditions as discussed above with regard to equations 1 and 2.

If on the other hand block 186 determines that the relief valve of the oil pump is still open (regulated flow), block 186 continues to measure the oil pressure and the oil temperature unit an unregulated flow is detected.

Turning now to block 188, once the oil pressure is measured, the used oil viscosity $\mu_{old}$ is obtained at step or block 190 using results of block 188 as well as equations 1 and 2 described above. Once the calculations of block 190 are complete, step or block 192 compares the used oil viscosity $\mu_{used}$ (determined at block 190) with the fresh oil viscosity $\mu_{new}$ determined by for example, dividing $\mu_{old}$ by $\mu_{new}$. At this point, the algorithm advances to step or block 194 wherein it is determined whether the compared viscosities are within a predetermined ranged defined by a lower constant C1 and an upper constant C2. If the compared values are outside the range defined by C1 and C2, an oil change signal 196 is generated; otherwise, a non-oil change signal 198 is generated.

Upon receipt of an oil change signal, the electronic controller provides an output connected to a display (not shown), which may be an LED signal device or other appropriate display means that is preferably in view of the engine operator, such as in the cab of a vehicle.

The electronic controller utilizes the algorithm which collects data from the sensors and the look up table to periodically determine if the oil needs changing.

A "change oil" warning signal can thus be sent to the vehicle operator when the viscosity estimated at a given oil temperature and engine speed exceeds a predetermined "threshold". It is noted that in accordance with the present disclosure the oil pressure read out is an existing feature readily available on some current production vehicles. Thus, there is no need to add an oil pressure sensor to implement the system of the present disclosure.

Accordingly, the algorithm of the FIG. 8 embodiment does not require the generation of a viscosity look up table (FIG. 6) as the viscosity is determined by the software in real time with regard to vehicle conditions.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the present disclosure not be limited to the particular embodiment disclosed as the best mode contemplated for carrying out this invention, but that the invention will include all embodiments falling within the scope of the appended claims. Furthermore, no element, component, or method step in the present disclosure is intended to be dedicated to the public regardless of whether the element, component, or method step is explicitly recited in the claims.

What is claimed is:

1. An oil change sensing system for an internal combustion engine, comprising:

an oil pressure sensor adapted to provide an oil pressure signal to an engine control module;

an oil temperature sensor adapted to provide an oil temperature signal to said engine control module; and a sensor for providing a signal to the engine control module, the signal being indicative of the rpm of the engine;

wherein said engine control module comprises an algorithm which, upon determining the oil temperature is in a range defined by a lower limit of 80 degrees Celsius and an upper limit of 120 degrees Celsius, determines the oil's viscosity by using the measured oil temperature, oil pressure, and the engine rpm and the determined oil viscosity and a fresh oil viscosity are used to determine whether the oil is in a preferred operating range.

2. The oil change sensing system as in claim 1, further comprising a look up table having oil viscosity measurements as a function of oil pressure.

3. The oil change sensing system as in claim 2, further comprising a means for determining whether the oil of the engine has been changed and updating the look up table by measuring and recording the viscosity of the oil in the engine after the oil in the engine has been changed wherein the recorded viscosity becomes said fresh oil viscosity.

4. The oil change sensing system as in claim 3, further comprising a means for determining whether a relief valve of an oil pump of the engine is closed.

5. The oil change sensing system as in claim 3, further comprising a means for determining whether the oil in the engine is in an unregulated flow.

6. The oil change sensing system as in claim 3, wherein the algorithm determines whether a relief valve of an oil pump of the engine is closed by measuring the oil pressure and the oil temperature.

7. The oil change sensing system as in claim 3, wherein the recorded viscosity is only obtained if the oil changing system has determined that the oil of the engine has been changed.

8. The oil change sensing system as in claim 2, wherein said look up table includes oil pressure measurements as a function of oil temperature and engine rpm.

9. A method for indicating whether the oil of an engine should be changed, comprising:

determining if the flow of the oil is unregulated, by measuring the oil pressure and the oil temperature;

retrieving a used oil viscosity and a fresh oil viscosity from a look up table;

determining whether the oil in the engine has been changed and if so said fresh oil viscosity is updated by obtaining a fresh oil viscosity from the look up table by measuring the oil pressure as a function of oil temperature and engine rpm, the engine rpm being determined by a sensor for providing a signal indicative of engine rpm; and using said used oil viscosity and a fresh oil viscosity to determine whether the oil's viscosity is in a preferred range.

10. The method as in claim 9, wherein the steps of the method are performed by an algorithm resident upon a microprocessor of an engine control module after determining the oil temperature is in a range defined by a lower limit of 80 degrees Celsius and an upper limit of 120 degrees Celsius.

* * * * *